US012352495B2

(12) United States Patent
Chishti et al.

(10) Patent No.: US 12,352,495 B2
(45) Date of Patent: Jul. 8, 2025

(54) RECOVERY OF NATURAL GAS LIQUIDS FROM A GAS STREAM

(71) Applicant: SAUDI ARABIAN OIL COMPANY, Dhahran (SA)

(72) Inventors: Khurram Saeed Chishti, Udhailiyah (SA); Ahmed Dhiya Al Ahmed, Al Qatif (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 146 days.

(21) Appl. No.: 18/177,570

(22) Filed: Mar. 2, 2023

(65) Prior Publication Data

US 2024/0219114 A1 Jul. 4, 2024

Related U.S. Application Data

(60) Provisional application No. 63/477,507, filed on Dec. 28, 2022.

(51) Int. Cl.
*F25J 3/02* (2006.01)

(52) U.S. Cl.
CPC ..... *F25J 3/0233* (2013.01); *F25J 3/0209* (2013.01); *F25J 2200/02* (2013.01); (Continued)

(58) Field of Classification Search
CPC ..... F25J 3/0238; F25J 3/0209; F25J 3/0233; F25J 2200/02; F25J 2200/40; (Continued)

(56) References Cited

U.S. PATENT DOCUMENTS 6,244,070 B1 * 6/2001 Lee ..... F25J 3/0209 62/620
6,354,105 B1 * 3/2002 Lee ..... F25J 3/0209 62/619

(Continued)

OTHER PUBLICATIONS

Ross, K., et al., "Strategies to Maximize Ethane Recovery with High-CO2 Feeds," Bryan Research and Engineering LLC, Apr. 21, 2021.

(Continued)

*Primary Examiner* — Frantz F Jules
*Assistant Examiner* — Webeshet Mengesha
(74) *Attorney, Agent, or Firm* — Vorys, Sater, Seymour and Pease LLP

(57) ABSTRACT

Processing of a feed gas stream containing methane and natural gas liquids may comprise: cooling a first portion of the feed gas stream to obtain a cooled first portion; introducing the cooled first portion into a liquid-vapor separator to obtain a vapor stream and a liquid stream; splitting the vapor stream into a first portion and a second portion; sub-cooling the second portion of the vapor stream to obtain a liquefied vapor stream; introducing the liquefied vapor stream into a demethanizer column; introducing the first portion of the vapor stream to at least one of an expansion valve or a turboexpander; obtaining an expanded vapor stream from the expansion valve or an expansion side of the turboexpander; introducing the expanded vapor stream and at least a first portion of the liquid stream into the demethanizer column; and obtaining from the demethanizer column a bottoms stream rich in natural gas liquids.

13 Claims, 2 Drawing Sheets

(52) U.S. Cl.
CPC ..... *F25J 2210/06* (2013.01); *F25J 2240/02* (2013.01); *F25J 2250/20* (2013.01)

(58) Field of Classification Search
CPC ..... F25J 2200/50; F25J 2200/76; F25J 2280/02; F25J 2210/06
See application file for complete search history.

(56) References Cited

U.S. PATENT DOCUMENTS

| | | | | |
|---|---|---|---|---|
| 7,107,788 | B2 | 9/2006 | Patel et al. | |
| 2009/0113930 | A1* | 5/2009 | Patel | F25J 3/0233 62/618 |
| 2020/0072546 | A1 | 3/2020 | Thom et al. | |
| 2020/0072547 | A1* | 3/2020 | Butts | F25J 3/0295 |
| 2022/0163257 | A1 | 5/2022 | Pierce et al. | |

OTHER PUBLICATIONS

Honeywell Uop/Ortloff, "Recycle Split Vapor 2 Process for Retrofits," Product Literature, 2019.

* cited by examiner

RECOVERY OF NATURAL GAS LIQUIDS FROM A GAS STREAM

FIELD OF THE DISCLOSURE

The present disclosure relates generally to recovery of natural gas liquids from a feed gas stream and, more particularly, to systems and methods for separating natural gas liquids from natural gas with enhanced recovery of the natural gas liquids.

BACKGROUND OF THE DISCLOSURE

Natural gas is a hydrocarbon resource comprising predominantly methane, as well as lesser amounts of heavier hydrocarbons such as ethane, propane, butane, pentane, and isomers thereof. Minor amounts of water, nitrogen, iron sulfide, and wax, for example, as well as other impurities, may also be present in the natural gas obtained from a given source. Natural gas is usually processed to separate methane from the heavier hydrocarbons and other components, wherein the methane may ultimately undergo liquefaction and be sold as liquefied natural gas (LNG). Dry gas also comprises mainly methane and may be sold in the gas state without necessarily becoming liquefied. The heavier hydrocarbons in a natural gas stream are either gases or extremely volatile liquids under standard conditions and likewise may be liquefied after separation from methane. As such, the heavier hydrocarbons in a natural gas stream (i.e., ethane, propane, butane, isobutane, pentane, 2-methyl-2-butane (isopentane), and neopentane are commonly referred to as natural gas liquids (NGL), since these hydrocarbons too may undergo liquefaction, typically more readily than does methane itself. Of the natural gas liquids, ethane is commonly obtained in the highest abundance relative to methane in a given natural gas stream. In addition to isolation from natural gas streams, natural gas liquids may also be recovered from other sources, such as refinery gas or synthetic gas streams, as well as from natural hydrocarbon sources such as coal, crude oil, naphtha, oil shale, tar sands, lignite, and the like.

Processes for separating methane from natural gas liquids may include those utilizing refrigeration or selective absorption, or cryogenic processes employing compression, expansion, and distillation. Since the goal of these separation processes is often to maximize recovery of methane for production of LNG, natural gas liquids may be isolated with varying degrees of efficiency. For example, cryogenic distillation processes to recover methane as the overhead stream from a demethanizer column may result in non-trivial amounts of ethane entraining with the overhead stream rather than condensing with other natural gas liquids in the bottoms stream. While methane is usually the most abundant and highest-demand component of natural gas, natural gas liquids are economically valuable as well. Hence, processes configured to maximize recovery of natural gas liquids from a gas stream, such as natural gas, may be highly desirable. Suitable gas streams may comprise crude natural gas, for example.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to embodiments consistent with the present disclosure, methods for processing a natural gas stream may comprise: providing a feed gas stream comprising methane and natural gas liquids in vapor form; splitting the feed gas stream into a first portion and a second portion; cooling the first portion of the feed gas stream to obtain a cooled first portion of the feed gas stream; introducing the cooled first portion of the feed gas stream into a liquid-vapor separator; obtaining a vapor stream and a liquid stream from the liquid-vapor separator; splitting the vapor stream into a first portion and a second portion; sub-cooling the second portion of the vapor stream to obtain a liquefied vapor stream; introducing the liquefied vapor stream into a demethanizer column; introducing the first portion of the vapor stream to at least one of an expansion valve or a turboexpander having an expansion side and a compression side connected by a shaft, the first portion of the vapor stream being introduced to the expansion side of the turboexpander; obtaining an expanded vapor stream from the expansion valve or the expansion side of the turboexpander; introducing the expanded vapor stream into the demethanizer column; introducing at least a first portion of the liquid stream into the demethanizer column; obtaining from the demethanizer column an overhead stream lean in natural gas liquids and a bottoms stream rich in natural gas liquids; compressing the overhead stream in the compression side of the turboexpander to obtain a pre-conditioned sales gas stream; and processing the pre-conditioned sales gas stream in a sales gas conditioning sub-module to obtain a conditioned sales gas stream.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
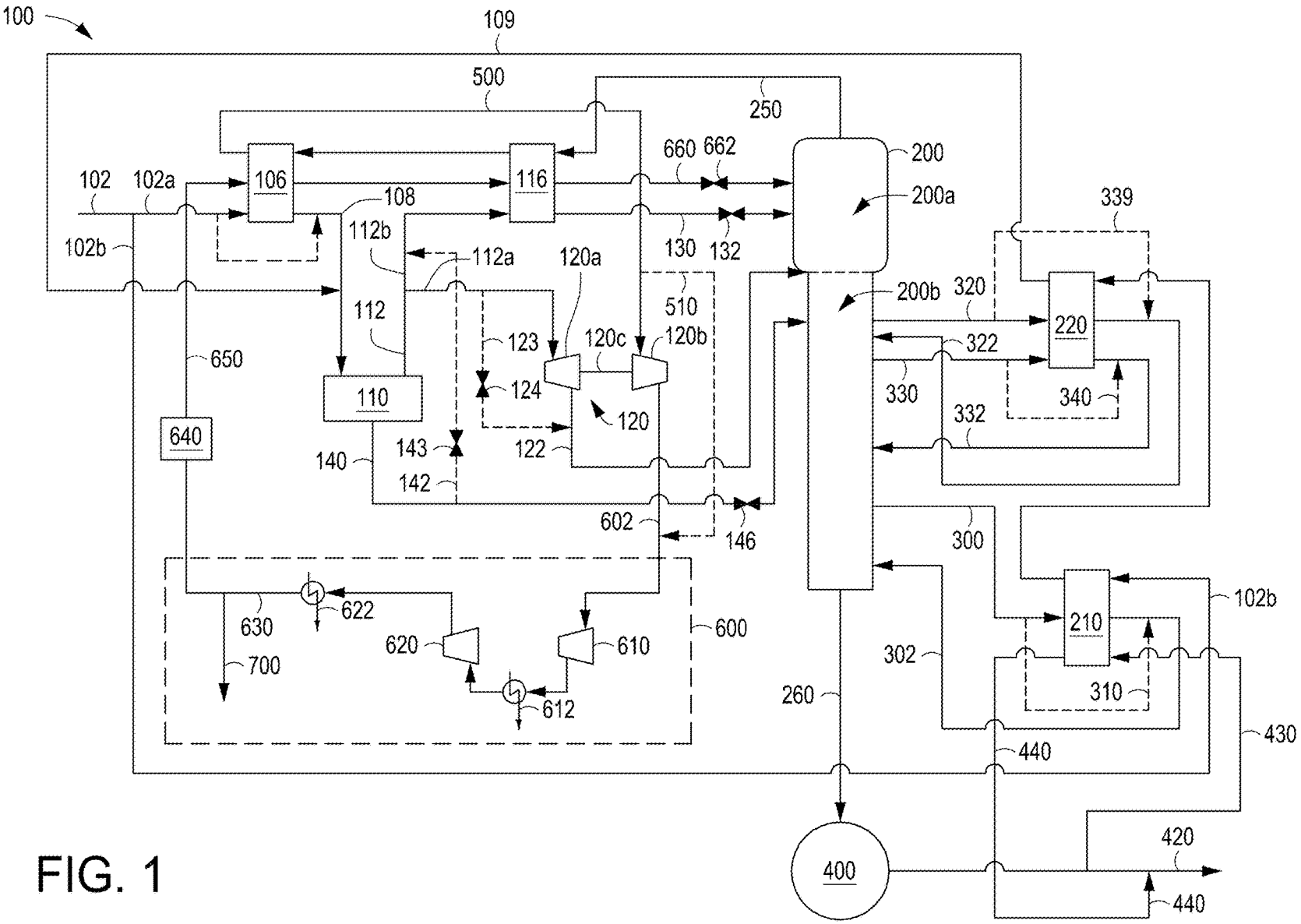
FIG. 1 is a diagram of a system and method for separating natural gas liquids from a feed gas stream according to the disclosure herein.

Embodiments in accordance with the present disclosure generally relate to recovery of natural gas liquids from a feed gas stream and, more particularly, to systems and methods for separating natural gas liquids from natural gas with enhanced recovery of the natural gas liquids.

Natural gas liquids represent a valuable component of natural gas that may not be isolated with optimal efficiency in many instances. For instance, while the bulk of natural gas liquids may be separated from a natural gas stream as the bottoms fraction of a demethanizer column, small amounts of ethane and other $C_{2+}$ natural gas liquids may be lost in the overhead stream (containing predominantly methane). Loss of natural gas liquids in the overhead stream may be mitigated to some degree by establishing a reflux containing relatively small quantities of natural gas liquids near the top of the demethanizer column. While it is often possible to hold losses of natural gas liquids in the overhead stream below an acceptable threshold, even small process upsets can disrupt separation conditions within the demethanizer column and result in non-trivial losses of ethane and other $C_{2+}$ natural gas liquids. Even small quantities of natural gas liquids entrained in the overhead stream may represent significant lost revenue in view of the large scale at which natural gas is usually processed. Stated alternately, even incremental improvement in the separation efficiency of natural gas liquids may afford significantly increased revenue in view of the large scale at which separation takes place.

The present disclosure provides process configurations for separating natural gas liquids as the bottoms stream in a demethanizer column, wherein the impact of process upsets therein may be rendered less significant. In particular, the process configurations disclosed herein may limit pressure and temperature variations within the various system components, particularly pressure variations within the demethanizer column, to aid in minimizing loss of natural gas liquids within the overhead stream of the demethanizer column as a consequence of changing conditions therein. The foregoing may be accomplished by establishing independent pressure controls for high-pressure and low-pressure portions of a system for separating natural gas liquids from natural gas, as discussed in greater detail hereinafter.

Additional process control may be realized by independent pressure and temperature monitoring at specified locations within the system for separating natural gas liquids in accordance with the foregoing. The independent pressure and temperature monitoring may be utilized to maintain particular system components within specified pressure and/or temperature regimes, which may stabilize performance of the demethanizer column. Additional description of the pressure and temperature monitoring locations, as well as the manner in which pressure and temperature data is utilized to operate the system with increased stability and enhanced recovery of natural gas liquids, is also discussed in greater detail hereinafter.

By implementing the process configurations and process controls described herein, an at least incremental improvement in the recovery of natural gas liquids from a natural gas stream may be realized. Given the usual large processing scale for natural gas, even minute increases in recovery of natural gas liquids from a natural gas stream may result in millions of dollars of additional revenue that would otherwise be lost as impurities in LNG. Moreover, by limiting the amount of natural gas liquids present within a methane stream, higher quality (purity) LNG may be produced and easier liquefaction may take place in some cases. It should be noted, however, that with decreased natural gas liquids present in LNG, the heating value of the LNG is decreased. Thus, depending on whether there is sufficient demand for the separated natural gas liquids and/or the desire to produce natural gas with a particular heating value, excess natural gas liquids may be reintroduced to LNG on an as-needed basis (or the natural gas liquids may not be separated from the natural gas stream as aggressively at the outset).

Embodiments of the present disclosure will now be described in detail with reference to the drawings. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the drawings may vary without departing from the scope of the present disclosure.

In system and process 100 of FIG. 1, feed gas stream 102 comprises methane and natural gas liquids in vaporized form. In one example, feed gas stream 102 may comprise crude or at least partially refined natural gas, for example. Upon entering system and process 100, feed gas stream 102 is split into first portion 102*a* and second portion 102*b*. A split ratio between first portion 102*a* and second portion 102*b* of feed gas stream 102 may be adjusted over a range of values to regulate performance of various system components, as discussed in greater detail hereinbelow. In general, the temperature and pressure of feed gas stream 102 incoming to system and process 100 are outside the control of a plant operator. As such, the process controls described herein may afford significant benefits during processing of the natural gas stream.

First portion 102*a* of feed gas stream 102 comprises at least a majority of feed gas stream 102, such as at least about 60% by volume, or at least about 70% by volume, or at least about 80% by volume, or at least about 90% by volume, or at least about 95% by volume. First portion 102*a* of feed gas stream 102 is introduced to feed gas heat exchanger 106, to which additional streams are introduced for promoting heat exchange, as discussed subsequently. First portion 102*a* of feed gas stream 102 undergoes cooling in feed gas heat exchanger 106 to afford cooled first portion 108. After exiting feed gas heat exchanger 106, cooled first portion 108 may be at least partially liquefied. In non-limiting examples, the temperature of cooled first portion 108 may be about −30° F. or below, or about −35° F., or below, or about −40° F. or below.

Cooled first portion 108 is conveyed from feed gas heat exchanger 106 to liquid-vapor separator 110. Liquid-vapor separator 110 may also be conventionally referred to as a low-temperature separator in view of the feed characteristics that it typically processes. Upon being introduced to liquid-vapor separator 110, cooled first portion 108 undergoes expansion and a temperature decrease to promote partial condensation, thereby producing a liquid in combination with a vapor in liquid-vapor separator 110. The pressure and temperature within liquid-vapor separator 110 may vary depending on the time of year and the external temperature present, as well as the temperature and pressure of feed gas stream 102. Vapor stream 112 exiting liquid-vapor separator 110 may be at a comparable temperature and pressure to the temperature conditions present therein.

Vapor stream 112 is obtained as an overhead stream from liquid-vapor separator 110 and is further split into first portion 112*a* and second portion 112*b*. Second portion 112*b* of vapor stream 112 is conveyed to sub-cooling heat exchanger 116, which may also be referred to as a condenser sub-cooler, to which additional streams are introduced for promoting heat exchange, as discussed subsequently, and first portion 112*a* of vapor stream 112 is conveyed to turboexpander 120. Turboexpander 120 includes expansion side 120*a* and compression side 120*b* connected by shaft 120*c*. Specifically, first portion 112*a* of vapor stream 112 is introduced to expansion side 120*a* of turboexpander 120, from which is obtained expanded vapor stream 122. Expanded vapor stream 122, which may comprise a mixture of liquid and vapor upon undergoing expansion, is further cooled relative to first portion 112*a* as a consequence of the expansion taking place in expansion side 120*a* of turboexpander 120. In non-limiting examples, the pressure of expanded vapor stream 122 may range from about 300 psi to about 350 psi, or about 325 psi to about 330 psi, and the temperature of expanded vapor stream 122 may range from about −105° F. to about −115° F., or about −108° F. to about −112° F. The thermal energy released upon cooling to produce expanded vapor stream 122 may be converted to mechanical energy in the form of shaft power to drive compression side 120*b* of turboexpander 120, as discussed hereinbelow. Compression side 120*b* of turboexpander 120 may be referred to as a brake compressor. Expanded vapor stream 122 (or a mixed liquid-vapor stream resulting therefrom) is then conveyed to demethanizer column 200 comprising upper portion 200*a* and lower portion 200*b*, each having different cross-sectional dimensions, additional details of which follow below. As shown, expanded vapor stream 122 may be conveyed to or near an interface between upper portion 200*a* and lower portion 200*b* of demethanizer column 200.

In non-limiting examples, upper portion 200*a* of demethanizer column 200 may contain at least two separated beds or trays (not shown). In some or other non-limiting examples, lower portion 200*b* of demethanizer column 200 may contain at least four separated beds or trays (not shown). Expanded vapor stream 122, introduced at or near the boundary of upper portion 200*a* and lower portion 200*b* of demethanizer column 200, may therefore be introduced above an uppermost bed or tray in lower portion 200*b* in demethanizer column 200.

Optionally, first portion 112*a* of vapor stream 112, or a portion thereof, may bypass expansion side 120*a* of turboexpander 120 and instead travel through bypass line 123 containing expansion valve 124. Expansion valve 124 may similarly promote expansion and cooling of first portion 112*a* of vapor stream 112. In non-limiting examples, expansion valve 124 may be a Joule-Thomson valve or similar type of throttling valve. After expansion of first portion 112*a* of vapor stream 112 takes place, bypass line 123 may rejoin the line carrying expanded vapor stream 122 to demethanizer column 200. In non-limiting examples, expansion valve 124 may promote expansion of first portion 112*a* of vapor stream 112 during startup or shutdown of system and process 100 (e.g., times during which turboexpander 120 is not fully operational and not capable of carrying the expansion duty). Alternately, expansion valve 124 may promote expansion in the event of failure or shutdown of turboexpander 120. Although FIG. 1 has depicted one expansion valve 124 bypassing turboexpander 120, it is to be appreciated that multiple expansion valves 124 may be disposed in parallel in some instances.

The operation of expansion side 120*a* of turboexpander 120 and/or expansion valve 124 may be regulated to adjust the pressure within demethanizer column 200 and/or sales gas conditioning sub-module 600. Additional process controls may aid in maintaining a desired temperature within liquid-vapor separator 110 to regulate the pressure within demethanizer column 200. Further details associated with the foregoing are discussed below.

Referring still to FIG. 1, second portion 112*b* of vapor stream 112 is conveyed to sub-cooling heat exchanger 116, in which additional cooling may take place. Upon additionally cooling second portion 112*b* of vapor stream 112 in sub-cooling heat exchanger 116, liquefied vapor stream 130 is obtained (i.e., the vapor within vapor stream 112 undergoes liquefaction in sub-cooling heat exchanger 116 to afford liquefied vapor stream 130). Liquefied vapor stream 130 may have a temperature as low as about −152° F. upon exiting sub-cooling heat exchanger 116. Liquefied vapor stream 130 may then pass through isolation valve 132 en route to demethanizer column 200. In particular, after passing through isolation valve 132, liquefied vapor stream 130 may undergo at least partial flashing upon being introduced to upper portion 200*a* of demethanizer column 200.

Liquid stream 140 is drained from liquid-vapor separator 110 as a bottoms stream. Optionally, a portion of liquid stream 140 may be diverted through branch line 142 and pass through isolation valve 143 en route to sub-cooling heat exchanger 116. Liquid stream 140 that is diverted through branch line 142 may join second portion 112*b* of vapor stream 112 and undergo concurrent processing therewith, as discussed further above. Diversion of a portion of liquid stream 140 through branch line 142 may aid in recovery of natural gas liquids from demethanizer column 200 by cooling the heavier natural gas liquids passing through branch line 142 for use as an intermediate reflux in demethanizer column 200.

The remainder of liquid stream 140 (or the entirety of liquid stream 140 if a portion thereof is not diverted through branch line 142) may pass through isolation valve 146 en route to demethanizer column 200. In particular, after passing through isolation valve 146, liquid stream 140 may undergo at least partial flashing upon being introduced to lower portion 200*b* of demethanizer column 200 below the location at which expanded vapor stream 122 is introduced to demethanizer column 200. In non-limiting examples, liquid stream 140 may be introduced to lower portion 200*b* of demethanizer column 200 below an uppermost bed or tray located therein. Other than one or more draw streams associated with bottom reboiler 210 and top reboiler 220, liquid stream may be a lower-most stream provided to demethanizer column 200.

Bottom reboiler 210 and top reboiler 220 utilize the heat present within feed gas stream 102 to promote heating of demethanizer column 200. As shown, second portion 102*b* of feed gas stream 102 is conveyed sequentially to bottom reboiler 210 and top reboiler 220 before being returned to liquid-vapor separator 110 as cooled second portion 109 of feed gas stream 102. As shown, cooled second portion 109 of feed gas stream 102 is combined with cooled first portion 108 of feed gas stream 102, which is obtained from first portion 102*a*. Although cooled second portion 109 of feed gas stream 102 is shown in FIG. 1 as being combined with cooled first portion 108 of feed gas stream 102 when subsequently introduced to liquid-vapor separator 110, it is to be appreciated that cooled first portion 108 of feed gas stream 102 and cooled second portion of feed gas stream 102 may alternately be introduced separately to liquid-vapor separator 110 before being subsequently combined.

As indicated above, second portion 102*b* of feed gas stream 102 promotes heating of fluids received from demethanizer column 200 into bottom reboiler 210 and top reboiler 220, thereby at least partially regulating the temperature profile therein. Bottom reboiler 210 may provide the primary heat duty needed to establish reflux within demethanizer column 200 and meet the methane specification within overhead stream 250 obtained therefrom. In particular, bottom reboiler 210 may promote heating of liquid within lower portion 200*b* of demethanizer column 200 to generate vapors that interact with a plurality of trays (not shown) to promote separation of methane within overhead stream 250. To accomplish the foregoing, bottom reboiler 210 receives lower draw stream 300 from demethanizer column 200, which then receives heat from second portion 102*b* of feed gas stream 102 and is then returned to demethanizer column 200 as heated lower draw stream 302. Lower draw stream 300 may be sourced from a lowermost bed or tray (not shown) within lower portion 200*b* of demethanizer column 200. Heated lower draw stream 302 is returned to demethanizer column 200 at a location below that at which lower draw stream 300 was obtained. In non-limiting examples, heated lower draw stream 302 may be returned to demethanizer column 200 below a lowermost bed or tray within lower portion 200*b* of demethanizer column 200. Heated lower draw stream 302 may be a lowermost stream returned to demethanizer column 200.

Optionally, at least a portion of lower draw stream 300 may be diverted from bottom reboiler 210 if the temperature or reflux rate within demethanizer column 200 is already within a desired range. As shown in FIG. 1, lower draw stream 300 may enter bypass line 310 and subsequently rejoin the line exiting lower reboiler 210 and containing heated lower draw stream 302. Bypass line 310 may be accessed on an as-needed basis using a valve therein (valve not shown). Thus, lower draw stream 300 not undergoing heating in bottom reboiler 210 may be returned to demethanizer column 200 in the same location at which heated lower draw stream 302 is returned. Additional processing controls and temperature sensors associated with bottom reboiler 210, discussed subsequently, may be utilized to determine whether lower draw stream 300 or a portion thereof should bypass bottom reboiler 210. Moreover, the temperature of heated lower draw stream 302 may be utilized, in part, to estimate a temperature in liquid-vapor separator 110 to provide additional processing controls.

Bottom reboiler 210 may also optionally receive additional streams for conducting heat exchange therein, as discussed subsequently. For example, bottom reboiler 210 may receive a natural gas liquids stream to provide additional heating duty. Bottom reboiler 210 may provide the reboiler duty needed to keep the methane specification of bottoms stream 260 below a desired threshold, such below about 1.5% on a volume basis relative to $C_{2+}$ hydrocarbons. Bottom reboiler 210 therefore may promote boiling of liquid from the bottom of demethanizer column 200 to generate vapors that drive the distillation separation.

As indicated above, after second portion 102*b* of feed gas stream 102 exits bottom reboiler 210 and promotes heating therein, second portion 102*b* further travels to top reboiler 220 and may promote additional heating of one or more draw streams obtained from a higher location in demethanizer column 200. Because second portion 102*b* of feed gas stream 102 has already given up some of its heat to lower draw stream 300, the one or more draw streams provided to top reboiler 220 may be heated to a lower temperature than is lower draw stream 300. The one or more draw streams originate at a location above that where lower draw stream 300 is obtained and below that at which liquid stream 140 enters demethanizer column 200.

As shown in FIG. 1, top reboiler 220 receives upper draw stream 320 and middle draw stream 330 from lower portion 200*b* of demethanizer column 200. Upper draw stream 320 enters top reboiler 220 and is heated by second portion 102*b* of feed gas stream 102 before being returned to demethanizer column 200 as heated upper draw stream 322. Heated upper draw stream 322 is returned to demethanizer column 200 at a location below which upper draw stream 320 is obtained. In non-limiting examples, upper draw stream 320 originates from a bed or tray immediately below an uppermost bed or tray in lower portion 200*b* of demethanizer column 200, and heated upper draw stream 322 is returned to demethanizer column 200 within a bed or tray immediately below the bed or tray from which upper draw stream 320 was withdrawn from demethanizer column 200. For instance, upper draw stream 320 may originate from a second bed or tray in lower portion 200*b* of demethanizer column 200, and heated upper draw stream 322 may be returned to demethanizer column 200 in a third bed or tray immediately below the second bed or tray in lower portion 200*b* of demethanizer column 200. Middle draw stream 330 enters top reboiler 220 and is also heated by second portion 102*b* of feed gas stream 102 before being returned to demethanizer column 200 as heated middle draw stream 332. Middle draw stream 330 is obtained at a location below which heated upper draw stream 322 is returned to demethanizer column 200. Heated middle draw stream 332 is returned to demethanizer column 200 at a location below which middle draw stream 330 is obtained. In non-limiting examples, heated middle draw stream 332 is returned to demethanizer column 200 within a lowermost bed or tray within lower portion 200*b* of demethanizer column 200. For instance, middle draw stream 330 may originate from a third bed or tray in lower portion 200*b* of demethanizer column 200, and heated middle draw stream 332 may be returned to demethanizer column 200 in a fourth bed or tray immediately below the third bed or tray in lower portion 200*b* of demethanizer column 200. The fourth bed or tray may constitute the lowermost bed or tray in lower portion 200*b* of demethanizer column 200.

Optionally, at least a portion of upper draw stream 320 and/or middle draw stream 330 may be diverted from top reboiler 220 if the temperature or reflux rate within demethanizer column 200 is already within a desired range. Diversion of either upper draw stream 320 or middle draw stream 330 may aid in avoiding overheating or overcooling of demethanizer column 200. As shown in FIG. 1, upper draw stream 320 may enter bypass line 339 and subsequently rejoin the line exiting top reboiler 220 and containing heated top draw stream 322. Similarly, middle draw stream 330 may enter bypass line 340 and subsequently rejoin the line exiting top reboiler 220 and containing heated middle draw stream 332. Bypass line 340 may be accessed on an as-needed basis using a valve therein (valve not shown). Thus, middle draw stream 330 not undergoing heating in top reboiler 220 may be returned to demethanizer column 200 at the same location at which heated middle draw stream 332 is returned. Additional processing controls and temperature sensors associated with top reboiler 220, discussed subsequently, may be utilized to determine whether upper draw stream 320 and/or middle draw stream 330 or a portion thereof should bypass top reboiler 220.

After providing feed gas stream 102 to demethanizer column 200 in accordance with the description above, overhead stream 250 and bottoms stream 260 are obtained from demethanizer column 200. In accomplishing the foregoing, the operating pressure within demethanizer column 200 may be about 450 psig or below, such as within a range of about 250 psig to about 400 psig or about 290 psig to 360 psig. Overhead stream 250 and bottoms stream 260 may be obtained within these pressure ranges as well. Overhead stream 250 is obtained in gaseous form and may comprise predominantly methane as the hydrocarbon(s) therein, preferably consisting of or consisting essentially of methane. Preferably, natural gas liquids are absent or substantially absent from overhead stream 250. For example, overhead stream 250 may comprise about 99% or greater, or about 99.5% or greater, or about 99.8% or greater, or about 99.9% or greater, or about 99.95% or greater, or about 99.99% or greater methane on a mass basis of all hydrocarbon(s) present therein. Optionally, overhead stream 250 may comprise varying amounts of non-hydrocarbon components such as nitrogen or carbon dioxide, for example.

Bottoms stream 260 is obtained in liquefied form and may comprise predominantly natural gas liquids, such as $C_2$-$C_5$ natural gas liquids. Preferably, bottoms stream 260 may consist of or consist essentially of natural gas liquids. Preferably, methane is absent or substantially absent from bottoms stream 260. For example, bottoms stream 260 may comprise about 90% or greater, or about 95% or greater, or about 98% or greater, or about 99% or greater, or about 99.5% or greater natural gas liquids on a mass basis of all hydrocarbon(s) present therein. It is to be appreciated that the distribution of particular natural gas liquids within bottoms stream 260 may be determined by the distribution of natural gas liquids originally present within feed gas stream 102.

Upon exiting demethanizer column 200, bottoms stream 260 is conveyed to natural gas liquids storage sphere 400 (or a plurality of natural gas liquids storage spheres 400). Suitable examples of natural gas liquids storage sphere 400 will be familiar to persons having ordinary skill in the art and may be similar to those used for storing LNG. The natural gas liquids within bottoms stream 260 may be held within natural gas liquids storage sphere 400 until end use thereof is desired. It is to be appreciated that end use 420 of the natural gas liquids separated according to the disclosure herein is not particularly limited. For example, the natural gas liquids may be further separated, bottled, used in chemical synthesis, and/or the like in the course of being provided to end use 420. Optionally, a portion of the natural gas liquids may be reblended with the methane obtained from overhead stream 250 if an increased heating value of the methane is desired.

A portion of the natural gas liquids within natural gas liquids storage sphere 400 may be discharged and provided to bottom reboiler 210 before being provided to end use 420. The natural gas liquids discharged from natural gas liquids storage sphere may have a temperature of about 40° F. to about 60° F. or about 45° F. to about 55° F. and therefore may serve as an additional heating fluid in bottom reboiler 210. As shown in FIG. 1, natural gas liquids stream 430 may be provided to bottom reboiler 210, and after being cooled therein, cooled natural gas liquids stream 440 may rejoin the natural gas liquids being provided to end use 420.

Overhead stream 250 is conveyed sequentially to sub-cooling heat exchanger 116 and feed gas heat exchanger 106 to promote, respectively, additional cooling of second portion 112*b* of vapor stream 112 and additional cooling of first portion 102*a* of feed gas stream 102 in each of these locations. After providing the additional cooling in feed gas heat exchanger 106, warmed overhead stream 500 is then conveyed to compressor side 120*b* of turboexpander 120 to provide pre-conditioned sales gas stream 602 exiting compressor side 120*b* of turboexpander 120. Optionally, a portion of warmed overhead stream 500 may be conveyed through bypass line 510, thereby not undergoing compression in compressor side 120*b* of turboexpander 120. Bypass line 510 may be accessed on an as-needed basis using a valve therein (valve not shown). For example, bypass line 510 may be utilized if turboexpander 120 is inoperative (e.g., during startup using expansion valve 124 or when undergoing maintenance). Warmed overhead stream 500 bypassing compressor side 120*b* of turboexpander 120 may rejoin pre-conditioned sales gas stream 602 downstream from compressor side 120*b* of turboexpander 120.

Pre-conditioned sales gas stream 602 (and any warmed overhead stream 500 bypassing compressor side 120*b* of turboexpander 120) is provided to sales gas conditioning sub-module 600, which may bring pre-conditioned sales gas stream 602 to pipeline conditions or other suitable conditions for dispensation. Within sales gas conditioning sub-module 600, pre-conditioned sales gas stream 602 is provided sequentially to compressors 610 and 620 to promote pressurization of the sales gas therein, followed by cooling after each compression in heat exchangers 612 and 622, respectively. Compressors 610 and 620 alternately may collectively define a two-stage compression system having a first compression stage and a second compression stage without interstage heat exchange in between. Heat exchangers 612 and 622 may promote cooling of the compressed sales gas through indirect heat exchange with chilled water, for example. Conditioned sales gas stream 630 is discharged from heat exchanger 622, and a portion of conditioned sales gas stream 630 is withdrawn for end use 700. Compressors 610 and 620 may raise the pressure of conditioned sales gas stream 630 to a pressure suitable for pipeline transport, for example.

A portion of conditioned sales gas stream 630 may be diverted from end use 700 for recirculation to demethanizer column 200. Specifically, recycle sales gas stream 650 may be diverted from end use 700 and undergo sequential recirculation to feed gas heat exchanger 106 and sub-cooling heat exchanger 116 to undergo cooling therein, thereby forming chilled, recycle sales gas stream 660. Chilled, recycle sales gas stream 660 may define a mixed liquid-vapor stream after passing through feed gas heat exchanger 106 and sub-cooling heat exchanger 116. In non-limiting examples, the discharge from compressor 620 may have a temperature of about 125° F. to about 150° F. or about 133° F. to about 140° F., and after passing through feed gas heat exchanger 106 and sub-cooling heat exchanger 116, the temperature may drop to about −35° F. to about −50° F. or about −40° F. to about −45° F. at the outlet of feed gas heat exchanger 106, and to a temperature of about −145° F. to about −165° F. or about −150° F. to about −160° F. (e.g., −155° F.) at the outlet of sub-cooling heat exchanger 116. Optionally, but preferably, recycle sales gas stream 650 is passed through line filter 640 before being further recirculated to remove entrained particulates, lubricants, or other incidental contaminants that may be introduced therein during processing. After recycle sales gas stream 650 is chilled in feed gas heat exchanger 106 and sub-cooling heat exchanger 116, chilled, recycle sales gas stream 660 may then pass through flow-control valve 662 en route to demethanizer column 200 as a top reflux stream. That is, chilled, recycle sales gas stream may comprise the topmost stream introduced to demethanizer column 200. Chilled, recycle sales gas stream 660 may be liquefied or predominantly liquefied, or may comprise a mixture of vapor and liquid phases (e.g., as a mixed liquid-vapor stream). Chilled, recycle sales gas stream 660 is then fed to upper portion 200*a* of demethanizer column 200. Because conditioned sales gas stream 630 comprises a high fraction of methane and minimal (if any) natural gas liquids, chilled recycle sales gas stream 660 consequently introduces predominantly or exclusively methane into upper portion 200*a* of demethanizer column 200. The resulting high methane content in upper portion 200*a* of demethanizer column 200 therefore discourages natural gas liquids from refluxing from lower portion 200*b* of demethanizer column 200 and becoming entrained in overhead stream 250. Therefore, by recirculating a portion of conditioned sales gas stream 630 to demethanizer column 200 in the foregoing manner, decreased loss of natural gas liquids in overhead stream 250 may be realized.

System and process 100 may aid in further promoting advantaged separation of natural gas liquids from feed gas stream 102 by providing pressure isolation between sales gas conditioning sub-module 600 and various components upstream therefrom. Turboexpander 120 may aid in promoting such pressure isolation. System components upstream from expansion side 120*a* of turboexpander 120 are maintained at high operating pressures. Once vapor stream 116 passes through expansion valve 124 and/or expansion side 120*a* of turboexpander 120, the pressure drops dramatically, such as from an upstream pressure of about 900 psig (of feed gas stream 102) or about 780 psig (at liquid-vapor separator 110) to a downstream pressure of about 350 psig after passing through expansion valve 124 and/or expansion side 120*a* of turboexpander 116. Demethanizer column 200 operates at a pressure of about 290 psig to 360 psig, and components discharged therefrom may be at a similar pressure before undergoing further processing, as discussed subsequently. Compression side 120*b* of turboexpander 120 raises the pressure of warmed overhead stream 500 by about 50 psig before providing pre-conditioned sales gas stream 602 to sales gas sub-module 600. Sales gas sub-module 600, in contrast, operates at a still lower pressure of about 290 psig to about 350 psig upstream from compressors 610 and 620 and is isolated from the high-pressure operating conditions by compression side 120*b* of turboexpander 120. As such, the pressure upstream from sales gas sub-module 600 may be regulated independently from the components upstream therefrom in bringing conditions sales gas stream to pipeline temperature and pressure conditions for subsequent transport.

The pressure within demethanizer column 200 and other system components upstream from turboexpander 120 may be susceptible to pressure fluctuations in feed gas stream 102, failure of one or more system components, or other process upsets. Changes in pressure within demethanizer column 200 may result in loss of natural gas liquids in overhead stream 250 and/or general loss in product quality of pre-conditioned sales gas stream 602 and/or natural gas liquids provided to end use 420. To maintain a steady pressure within demethanizer column 200, the pressure upstream from turboexpander 120 may be monitored, and the measured pressure may be utilized to regulate the operation of turboexpander 120 (and/or expansion valve 124), as described hereinafter. In non-limiting examples, the upstream pressure may be measured using a pressure sensor in communication with liquid-vapor separator 110. Because the output of expansion side 120*a* of turboexpander 120 (and/or expansion valve 124) directly feeds demethanizer column 200, regulation of these components may directly impact the pressure therein.

To regulate operation of turboexpander 120 for purposes of achieving pressure control within demethanizer column 200, the circulation rate of fluids through expansion side 120*a* of turboexpander 120 may be adjusted based on the measured pressure value. The circulation rate through expansion side 120*a* of turboexpander 120 (and/or the flow rate through bypass line and expansion valve 123) may be adjusted to increase or decrease the pressure as needed. In particular, the circulation rate of fluids through the inlet gate vanes (IGVs) of expansion side 120*a* of turboexpander 120 may be increased or decreased to maintain the pressure of demethanizer column 200 at a desired level. For example, increasing the circulation rate may increase the pressure in demethanizer column 200, and decreasing the circulation rate may lower the pressure.

Since expansion side 120*a* and compression side 120*b* of turboexpander 120 are coupled by shaft 120*c*, the amount of work produced by expansion side 120*a* may dictate the amount of compression taking place on compression side 120*b*. The amount of compression taking place on compression side 120*b* of turboexpander 120, in turn, may dictate the pressure of pre-conditioned sales gas stream 602 introduced to sales gas conditioning sub-module 600. Because compressors 610 and 620 in sales gas conditioning sub-module 600 may be operated independently from components located upstream therefrom, sale gas conditioning sub-module 600 is effectively pressure isolated from components upstream therefrom. Thus, compression side 120*b* of turboexpander 120 effectively defines a gateway providing pressure isolation of sales gas conditioning sub-module 600 from other system components.

Another technique for maintaining the pressure within demethanizer column 200 within a desired range is to also maintain the column temperature within a pre-determined range of temperature values, since the content of overhead stream 250 exiting demethanizer column 200 is dependent upon both the pressure and temperature therein. Temperature control within demethanizer column 200 may be established in several complementary ways, as discussed hereinafter.

First, the heat duty of bottom reboiler 210 may be regulated by the amount of second portion 102*b* of feed gas stream 102 provided thereto. The amount of second portion 102*b* of feed gas stream 102 is, in turn, determined by the relative circulation rates of first portion 102*a* and second portion 102*b* of feed gas stream 102. Thus, a split ratio between first portion 102*a* and second portion 102*b* of feed gas stream 102 may be determined in response to the required heat duty of bottom reboiler 210. In particular, second portion 102*b* of feed gas stream 102 may be provided to bottom reboiler 210 in an amount sufficient to maintain heated lower draw stream 302 within a desired range. In non-limiting examples, a suitable temperature range for heated lower draw stream 302 may range from about 40° C. to about 50° C., or about 44° C. to about 46° C., or about 45.5° C. to about 46.5° Lower draw stream 300 may have a temperature ranging from about 35° C. to about 40° C. Typically, the split ratio is such that a majority of feed gas stream 102 is located within first portion 102*a* and a minority of feed gas stream 102 is located within second portion 102*b*. Accordingly, the split ratio between first portion 102*a* and second portion 102*b* may range from about 50:50 to about 99:1, or 70:30 to about 99:1, or about 75:25 to about 99:1, or about 80:20 to about 99:1, or about 85:15 to about 99:1, or about 90:10 to about 99:1. Preferably, system and method 100 may act autonomously to maintain the split ratio at a value sufficient to keep the temperature of heated lower draw stream 302 within a suitable range. The temperature of feed gas stream 102 may further be accounted for in determining a suitable split ratio to accomplish the foregoing.

Figure 2:
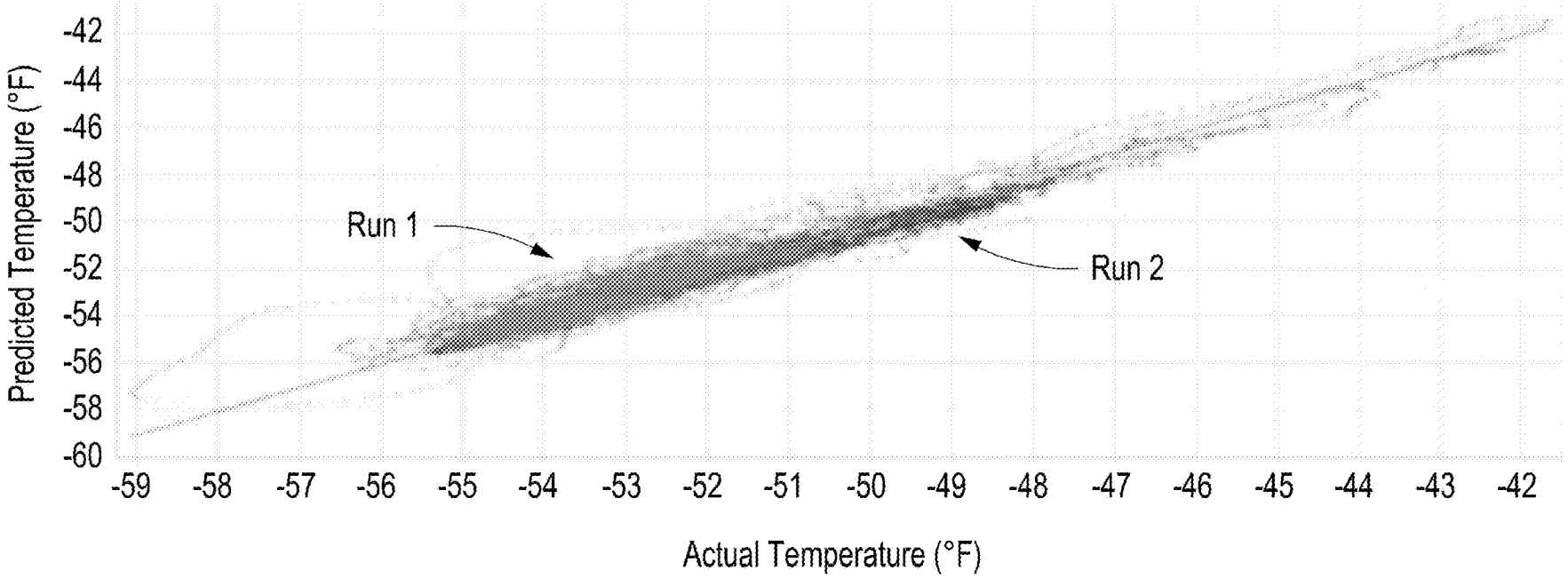
FIG. 2 is a graph of predicted temperature versus actual temperature in a liquid-vapor separator operated according to the disclosure herein.

In another aspect of temperature control within demethanizer column 200, the temperature within liquid-vapor separator 110 may be held within a specified range, which may aid in maintaining desired temperature conditions within demethanizer column 200. In particular, the temperature within liquid-vapor separator 110 may determine the temperature of vapor stream 112 and liquid stream 140 that are ultimately provided to demethanizer column 200, thereby impacting the temperature achieved therein. A target temperature within liquid-vapor separator 110 may be estimated based upon inputs from several sources. In particular, the target temperature within liquid-vapor separator 110 may be estimated based on at least the temperature of first portion 102*a* of feed gas stream 102 exiting feed gas heat exchanger 106 and the temperature of heated lower draw stream 302. Based on the temperature of heated lower draw stream 302, the split ratio between first portion 102*a* and second portion 102*b* of feed gas stream 102 may be determined to maintain liquid-vapor separator 110 and demethanizer column 200 within desired temperature ranges. By estimating the temperature within liquid-vapor separator 110 in the foregoing manner, good agreement between predicted and actual temperature values may be realized. FIG. 2 is a graph showing a plot of predicted versus actual temperature values in liquid-vapor separator 110. By predicting the temperature within liquid-vapor separator 110 in the foregoing manner, it may be possible to forego adjustment of plant parameters to reach a proper equilibrium state resulting from variation of the temperature of liquid-vapor separator 110, which may arise from variation in feed composition, over-refluxing of demethanizer column 200, and/or performance variation of bottom reboiler 210 and top reboiler 220.

In non-limiting examples, the temperature within liquid-vapor separator 110 may be held within a range of about −40° F. to about −60° F., or about −35° F. to about −60° F., or about −40° F. to about −60° F., or about −45° F. to about −55° F. Cooled first portion 108 of feed gas stream 102 may reside within the same range. The target temperature of liquid-vapor separator 110, in turn, may be used to set a target temperature for cooled first portion 108 of feed gas stream 102 exiting feed gas heat exchanger 106.

Embodiments disclosed herein include:

A. Methods for processing a natural gas stream. The methods comprise: providing a feed gas stream comprising methane and natural gas liquids in vapor form; splitting the feed gas stream into a first portion and a second portion; cooling the first portion of the feed gas stream to obtain a cooled first portion of the feed gas stream; introducing the cooled first portion of the feed gas stream into a liquid-vapor separator; obtaining a vapor stream and a liquid stream from the liquid-vapor separator; splitting the vapor stream into a first portion and a second portion; sub-cooling the second portion of the vapor stream to obtain a liquefied vapor stream; introducing the liquefied vapor stream into a demethanizer column; introducing the first portion of the vapor stream to at least one of an expansion valve or a turboexpander having an expansion side and a compression side connected by a shaft, the first portion of the vapor stream being introduced to the expansion side of the turboexpander; obtaining an expanded vapor stream from the expansion valve or the expansion side of the turboexpander; introducing the expanded vapor stream into the demethanizer column; introducing at least a first portion of the liquid stream into the demethanizer column; obtaining from the demethanizer column an overhead stream lean in natural gas liquids and a bottoms stream rich in natural gas liquids; compressing the overhead stream in the compression side of the turboexpander to obtain a pre-conditioned sales gas stream; and processing the pre-conditioned sales gas stream in a sales gas conditioning sub-module to obtain a conditioned sales gas stream.

Embodiment A may have one or more of the following additional elements in any combination:

Element 1: wherein processing the pre-conditioned sales gas stream comprises compressing the pre-conditioned sales gas stream in one or more compressors that are independent of the turboexpander.

Element 2: wherein a portion of the conditioned sales gas stream is recirculated to the demethanizer column after passing through first and second heat exchangers, the first heat exchanger also cooling the first portion of the feed gas stream and the second heat exchanger also sub-cooling the second portion of the vapor stream.

Element 3: wherein the portion of the conditioned sales gas stream recirculated to the demethanizer column is an uppermost stream provided to the demethanizer column.

Element 4: wherein the overhead stream is circulated sequentially through the second and first heat exchangers before being compressed in the compression side of the turboexpander.

Element 5: wherein the second portion of the feed gas stream is circulated sequentially through a bottom reboiler and a top reboiler, each reboiler receiving one or more draw streams from the demethanizer column and returning one or more warmed draw streams to the demethanizer column.

Element 6: wherein the second portion of the feed gas stream is recirculated to the liquid-vapor separator after exiting the top reboiler.

Element 7: wherein a portion of the natural gas liquids are recirculated to the bottom reboiler.

Element 8: wherein the process further comprises monitoring a temperature of a warmed draw stream returning to the demethanizer column from the bottom reboiler and a temperature of the cooled first portion of the feed gas stream; estimating a temperature of the liquid-vapor separator based upon the temperature of the warmed draw stream returning to the demethanizer column from the bottom reboiler and the temperature of the cooled first portion of the feed gas stream; and adjusting a split ratio between the first portion and the second portion of the feed gas stream if the temperature of the liquid-vapor separator is outside a desired range.

Element 9: wherein the warmed draw stream returning to the demethanizer column from the bottom reboiler is a lowermost stream provided to the demethanizer column.

Element 10: wherein the liquefied vapor stream is introduced to the demethanizer column as a second most uppermost stream provided to the demethanizer column.

Element 11: wherein the demethanizer column has an upper portion and a lower portion having different cross-sectional dimensions, and the expanded vapor stream is introduced to the demethanizer column at an interface between the upper portion and the lower portion.

Element 12: wherein the first portion of the liquid stream is introduced to the demethanizer column at a location below the expanded vapor stream in the lower portion of the demethanizer column.

Element 13: wherein the process further comprises monitoring a pressure upstream from the sales gas conditioning sub-module; and increasing or decreasing a circulation rate of the first portion of the vapor stream to the expansion valve or the turboexpander in response to the pressure.

Element 14: wherein the feed gas stream comprises ethane, and about 97% of the ethane by volume is recovered in the bottoms stream.

By way of non-limiting example, exemplary combinations applicable to A include, but are not limited to: 1 and 2; 1 and 3; 1, 3, and 4; 1 and 5; 1, 5, and 6; 1, 5, and 7; 1, 5, and 8; 1, 5, and 9; 1 and 10; 1 and 11; 1, 11, and 12; 1 and 13; 1 and 14; 2 and 3; 2-4; 2 and 5; 2, 5, and 6; 2, 5, and 7; 2, 5, and 8; 2, 5, and 9; 2 and 10; 2 and 11; 2, 11, and 12; 2 and 13; 2 and 14; 3 and 4; 3 and 5; 3, 5, and 6; 3, 5, and 7; 3, 5, and 8; 3, 5, and 9; 3 and 10; 3 and 11; 3, 11, and 12; 3 and 13; 3 and 14; 3-5; 3-6; 3-5, and 7; 3-5, and 8; 3-5, and 9; 3, 4, and 10; 3, 4, and 11; 3, 4, 11, and 12; 3 and 13; 3 and 14; 5 and 6; 5 and 7; 5 and 8; 5 and 9; 5-7; 5-8; 5-9; 5, 6, and 8; 5, 6, and 9; 5, 7, and 8; 5, 7, and 9; 5-7, and 9; 10 and 11; 10-12; 10 and 13; 10 and 14; 11 and 12; 11-13; 11 and 13; 11 and 14; and 13 and 14.

The present disclosure is further directed to the following non-limiting clauses:

Clause 1. A process comprising:

providing a feed gas stream comprising methane and natural gas liquids in vapor form; splitting the feed gas stream into a first portion and a second portion;

cooling the first portion of the feed gas stream to obtain a cooled first portion of the feed gas stream;

introducing the cooled first portion of the feed gas stream into a liquid-vapor separator; obtaining a vapor stream and a liquid stream from the liquid-vapor separator;

splitting the vapor stream into a first portion and a second portion;

sub-cooling the second portion of the vapor stream to obtain a liquefied vapor stream; introducing the liquefied vapor stream into a demethanizer column;

introducing the first portion of the vapor stream to at least one of an expansion valve or a turboexpander having an expansion side and a compression side connected by a shaft, the first portion of the vapor stream being introduced to the expansion side of the turboexpander;

obtaining an expanded vapor stream from the expansion valve or the expansion side of the turboexpander;

introducing the expanded vapor stream into the demethanizer column;

introducing at least a first portion of the liquid stream into the demethanizer column; obtaining from the demethanizer column an overhead stream lean in natural gas liquids and a bottoms stream rich in natural gas liquids;

compressing the overhead stream in the compression side of the turboexpander to obtain a pre-conditioned sales gas stream; and processing the pre-conditioned sales gas stream in a sales gas conditioning sub-module to obtain a conditioned sales gas stream.

Clause 2. The process of clause 1, wherein processing the pre-conditioned sales gas stream comprises compressing the pre-conditioned sales gas stream in one or more compressors that are independent of the turboexpander.

Clause 3. The process of clause 1 or clause 2, wherein a portion of the conditioned sales gas stream is recirculated to the demethanizer column after passing through first and second heat exchangers, the first heat exchanger also cooling the first portion of the feed gas stream and the second heat exchanger also sub-cooling the second portion of the vapor stream.

Clause 4. The process of clause 3, wherein the portion of the conditioned sales gas stream recirculated to the demethanizer column is an uppermost stream provided to the demethanizer column.

Clause 5. The method of clause 3 or clause 4, wherein the overhead stream is circulated sequentially through the second and first heat exchangers before being compressed in the compression side of the turboexpander.

Clause 6. The process of any one of clauses 1-5, wherein the second portion of the feed gas stream is circulated sequentially through a bottom reboiler and a top reboiler, each reboiler receiving one or more draw streams from the demethanizer column and returning one or more warmed draw streams to the demethanizer column.

Clause 7. The process of clause 6, wherein the second portion of the feed gas stream is recirculated to the liquid-vapor separator after exiting the top reboiler.

Clause 8. The process of clause 6 or clause 7, wherein a portion of the natural gas liquids are recirculated to the bottom reboiler.

Clause 9. The process of any one of clauses 6-8, further comprising:

monitoring a temperature of a warmed draw stream returning to the demethanizer column from the bottom reboiler and a temperature of the cooled first portion of the feed gas stream;

estimating a temperature of the liquid-vapor separator based upon the temperature of the warmed draw stream returning to the demethanizer column from the bottom reboiler and the temperature of the cooled first portion of the feed gas stream; and adjusting a split ratio between the first portion and the second portion of the feed gas stream if the temperature of the liquid-vapor separator is outside a desired range.

Clause 10. The process of any one of clause 6-9, wherein the warmed draw stream returning to the demethanizer column from the bottom reboiler is a lowermost stream provided to the demethanizer column.

Clause 11. The process of any one of clauses 1-10, wherein the liquefied vapor stream is introduced to the demethanizer column as a second most uppermost stream provided to the demethanizer column.

Clause 12. The process of any one of clauses 1-11, wherein the demethanizer column has an upper portion and a lower portion having different cross-sectional dimensions, and the expanded vapor stream is introduced to the demethanizer column at an interface between the upper portion and the lower portion.

Clause 13. The process of clause 12, wherein the first portion of the liquid stream is introduced to the demethanizer column at a location below the expanded vapor stream in the lower portion of the demethanizer column.

Clause 14. The process of any one of clauses 1-13, further comprising:

monitoring a pressure upstream from the sales gas conditioning sub-module; and increasing or decreasing a circulation rate of the first portion of the vapor stream to the expansion valve or the turboexpander in response to the pressure.

Clause 15. The process of any one of clauses 1-14, wherein the feed gas stream comprises ethane, and about 97% of the ethane by volume is recovered in the bottoms stream.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

All documents described herein are incorporated by reference herein for purposes of all jurisdictions where such practice is allowed, including any priority documents and/or testing procedures to the extent they are not inconsistent with this text. As is apparent from the foregoing general description and the specific embodiments, while forms of the disclosure have been illustrated and described, various modifications can be made without departing from the spirit and scope of the disclosure. Accordingly, it is not intended that the disclosure be limited thereby. For example, the compositions described herein may be free of any component, or composition not expressly recited or disclosed herein. Any method may lack any step not recited or disclosed herein. Likewise, the term "comprising" is considered synonymous with the term "including." Whenever a method, composition, element or group of elements is preceded with the transitional phrase "comprising," it is understood that we also contemplate the same composition or group of elements with transitional phrases "consisting essentially of," "consisting of," "selected from the group of consisting of," or "is" preceding the recitation of the composition, element, or elements and vice versa.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by one or more embodiments described herein. At the very least, and not as an attempt to limit the application of the doctrine of equivalents to the scope of the claim, each numerical parameter should at least be construed in light of the number of reported significant digits and by applying ordinary rounding techniques.

The invention claimed is:

1. A process comprising:

providing a feed gas stream comprising methane and natural gas liquids in vapor form;

splitting the feed gas stream into a first portion and a second portion;

cooling the first portion of the feed gas stream in a first heat exchanger to obtain a cooled first portion of the feed gas stream;

introducing the cooled first portion of the feed gas stream into a liquid-vapor separator;

obtaining a vapor stream and a liquid stream from the liquid-vapor separator;

splitting the vapor stream into a first portion and a second portion;

conveying the second portion of the vapor stream directly from the liquid-vapor separator to a second heat exchanger;

sub-cooling the second portion of the vapor stream in the second heat exchanger to obtain a liquefied vapor stream;

introducing the liquefied vapor stream into a demethanizer column;

wherein the second portion of the feed gas stream is circulated sequentially through a bottom reboiler and a top reboiler, each reboiler receiving one or more draw streams from the demethanizer column and returning one or more warmed draw streams to the demethanizer column;

introducing the first portion of the vapor stream to at least one of an expansion valve or a turboexpander having an expansion side and a compression side connected by a shaft, the first portion of the vapor stream being introduced to the expansion side of the turboexpander;

obtaining an expanded vapor stream from the expansion valve or the expansion side of the turboexpander;

introducing the expanded vapor stream into the demethanizer column;

introducing at least a first portion of the liquid stream into the demethanizer column;

monitoring a temperature of at least one of the one or more warmed draw streams returning to the demethanizer column from the bottom reboiler and a temperature of the cooled first portion of the feed gas stream;

estimating a temperature of the liquid-vapor separator based upon the temperature of the at least one of the one or more warmed draw streams returning to the demethanizer column from the bottom reboiler and the temperature of the cooled first portion of the feed gas stream;

adjusting a split ratio between the first portion and the second portion of the feed gas stream if the temperature of the liquid-vapor separator is outside a desired range;

obtaining from the demethanizer column an overhead stream lean in natural gas liquids and a bottoms stream rich in natural gas liquids;

compressing the overhead stream in the compression side of the turboexpander to obtain a pre-conditioned sales gas stream; and processing the pre-conditioned sales gas stream in a sales gas conditioning sub-module to obtain a conditioned sales gas stream.

2. The process of claim 1, wherein processing the pre-conditioned sales gas stream comprises compressing the pre-conditioned sales gas stream in one or more compressors that are independent of the turboexpander.

3. The process of claim 2, wherein a portion of the conditioned sales gas stream is recirculated to the demethanizer column after passing through the first and second heat exchangers.

4. The process of claim 3, wherein the portion of the conditioned sales gas stream recirculated to the demethanizer column is an uppermost stream provided to the demethanizer column.

5. The process of claim 3, wherein the overhead stream is circulated sequentially through the second and first heat exchangers before being compressed in the compression side of the turboexpander.

6. The process of claim 1, wherein the second portion of the feed gas stream is recirculated to the liquid-vapor separator after exiting the top reboiler.

7. The process of claim 1, wherein a portion of the natural gas liquids is recirculated to the bottom reboiler.

8. The process of claim 1, wherein the at least one of the one or more warmed draw streams returning to the demethanizer column from the bottom reboiler is a lowermost stream provided to the demethanizer column.

9. The process of claim 1, wherein the liquefied vapor stream is introduced to the demethanizer column as a second most uppermost stream provided to the demethanizer column.

10. The process of claim 1, wherein the demethanizer column has an upper portion and a lower portion having different cross-sectional dimensions, and the expanded vapor stream is introduced to the demethanizer column at an interface between the upper portion and the lower portion.

11. The process of claim 10, wherein the first portion of the liquid stream is introduced to the demethanizer column at a location below the expanded vapor stream in the lower portion of the demethanizer column.

12. The process of claim 1, further comprising:

monitoring a pressure upstream from the sales gas conditioning sub-module; and increasing or decreasing a circulation rate of the first portion of the vapor stream to the expansion valve or the turboexpander in response to the pressure.

13. The process of claim 1, wherein the feed gas stream comprises ethane, and about 97% of the ethane by volume is recovered in the bottoms stream.

* * * * *